US011066768B2

(12) United States Patent
Umekawa

(10) Patent No.: US 11,066,768 B2
(45) Date of Patent: Jul. 20, 2021

(54) FLY EDGESTITCHING APPARATUS

(71) Applicant: YKK Corporation, Tokyo (JP)

(72) Inventor: Toru Umekawa, Kurobe (JP)

(73) Assignee: YKK Corporation, Tokyo (JP)

( * ) Notice: Subject to any disclaimer, the term of this patent is extended or adjusted under 35 U.S.C. 154(b) by 117 days.

(21) Appl. No.: 16/615,811

(22) PCT Filed: May 22, 2017

(86) PCT No.: PCT/JP2017/018996
§ 371 (c)(1),
(2) Date: Nov. 21, 2019

(87) PCT Pub. No.: WO2018/216061
PCT Pub. Date: Nov. 29, 2018

(65) Prior Publication Data

US 2020/0109501 A1 Apr. 9, 2020

(51) Int. Cl.
*D05B 35/10* (2006.01)
*D05B 35/06* (2006.01)

(52) U.S. Cl.
CPC ..... *D05B 35/10* (2013.01); *D05B 35/064* (2013.01)

(58) Field of Classification Search
CPC .... D05B 35/064; D05B 35/10; D05B 35/102; D05B 1/18; D05B 1/20
See application file for complete search history.

(56) References Cited

U.S. PATENT DOCUMENTS 5,069,148 A * 12/1991 Ishikawa ..... D05B 35/102 112/104
5,161,474 A * 11/1992 Ishikawa ..... D05B 33/00 112/122

(Continued)

FOREIGN PATENT DOCUMENTS

CN 103269612 A 8/2013
JP 07-289764 A 11/1995

(Continued)

OTHER PUBLICATIONS

Office Action, Chinese Patent Application No. 201780091088.4, dated Dec. 31, 2020, 12 pages.

(Continued)

*Primary Examiner* — Nathan E Durham
(74) *Attorney, Agent, or Firm* — Kilpatrick Townsend & Stockton LLP

(57) ABSTRACT

An edge stitching device for a fly includes a table on which the fly is placed, a clamping device which sandwiches the fly in cooperation with the table, a sewing machine which edge-stitches an edge of a fly body, a cutter provided in the sewing machine and cut the fly body to form the curved side, and a clamping device conveying device which conveys the clamping device in a sandwiched state. The clamping device conveying device continuously performs: pre-edge-stitching conveyance, in which the clamping device is linearly conveyed toward the sewing machine in a state where the fly is sandwiched before edge stitching; and edge stitching conveyance, in which the clamping device is conveyed in a state where the fly is sandwiched during the edge stitching. In the edge stitching conveyance, the clamping device is conveyed in accordance with a shape of the curved side formed by the cutter.

10 Claims, 9 Drawing Sheets

(56) References Cited

U.S. PATENT DOCUMENTS

| | | | | |
|---|---|---|---|---|
| 5,170,733 | A * | 12/1992 | Honma | D05B 35/102 112/122 |
| 6,237,518 | B1 | 5/2001 | Yunoki et al. | |
| 2006/0144309 | A1* | 7/2006 | Sho | D05B 35/064 112/470.33 |
| 2007/0017425 | A1* | 1/2007 | Sho | D05B 35/107 112/308 |
| 2008/0115710 | A1 | 5/2008 | Ishikawa | |
| 2013/0092067 | A1* | 4/2013 | Sawada | D05B 27/10 112/470.33 |

FOREIGN PATENT DOCUMENTS

| | | | |
|---|---|---|---|
| JP | 2000-070579 | A | 3/2000 |
| WO | 2012/032615 | A1 | 3/2012 |

OTHER PUBLICATIONS

International Preliminary Report on Patentability, PCT Application No. PCT/JP2017/018996, dated Nov. 26, 2019.
International Search Report, PCT Application No. PCT/JP2017/018996, dated Aug. 15, 2017.
Written Opinion, PCT Application No. PCT/JP2017/018996, dated Aug. 15, 2017.

* cited by examiner

FLY EDGESTITCHING APPARATUS

TECHNICAL FIELD

The present invention relates to a device configured to stitch an edge of a fly which is an object to be stitched, that is, an edge stitching device for the fly. The fly includes a slide fastener and a fly body which is a fabric to which the slide fastener is attached. The term "edge stitching" refers to stitching of edges of the fly body such that the edges do not fray.

BACKGROUND ART

A fly refers to, for example, in a case of a front of a pair of trousers, a part that includes: a fly body which is generally rectangular and includes one arc-shaped corner portion; and a slide fastener that is attached to the fly body. An example of an edge stitching device for a fly in related art includes: a linear supply unit, which linearly supplies the front serving as the fly toward an edge stitching unit serving as a sewing machine; a rotation supply unit, which receives the front from the linear supply unit and rotates so as to supply the front toward the edge stitching unit; and the edge stitching unit (sewing machine), which performs edge stitching for the front while sending out the front.

CITATION LIST

Patent Literature

[Patent Literature 1] JP-A-2000-70579

SUMMARY OF INVENTION

Technical Problem

Since the fly (fly body), such as the front, is flexible, the fly is slightly deformed when being pressed by the linear supply unit or the rotation supply unit. In the edge stitching device described above, when the front is passed from the linear supply unit to the rotation supply unit, a position where the front is pressed is changed. As a result, postures of the front may be slightly different before and after the change of the pressing position, and thus quality of edge stitching of the front may be adversely affected. For this reason, the edge stitching device described above is not actually used. Therefore, it is desirable to keep a posture of a fly as constant as possible when the fly is conveyed for edge stitching.

Although not disclosed in the above-mentioned Patent Literature 1, when the fly is subjected to the edge stitching, an end portion of one tape among two tapes of the slide fastener is preferably stitched together with the fly body, while an end portion of the other tape is not stitched together. More details are as follows. The sewing machine stitches a fabric passed under a sewing machine foot. Therefore, during the edge stitching, the other (not to be stitched) tape should not be passed under the sewing machine foot together with the fly body, in other words, the other tape should be passed above the sewing machine foot. Otherwise, it will be difficult to stitch the fly to the trousers. To stitch the fly to the trousers is to stitch the fly body (where the one tape is stitched) to one fabric among two fabrics of the trousers while stitching the other tape to the other fabric.

The present invention is made in view of the above circumstances, and an object of the present invention is to solve at least one of the problems described above.

Solution to Problem

An object to be stitched by an edge stitching device for a fly according to the present invention is the following fly. The fly includes a lower fly body having an edge where a horizontal side and a vertical side extending straight in intersecting directions are joined by a curved side, in which a slide fastener on an upper side is superimposed on the fly body. An extending direction of the vertical side of the fly body is aligned with a longitudinal direction of the slide fastener. Two end portions of the fly body in an extending direction of the horizontal side are protruded from the slide fastener to two width direction sides of the slide fastener.

The edge stitching device for the fly according to the present invention includes: a table on which the fly is placed; a clamping device which sandwiches the fly in cooperation with the table; a sewing machine which edge-stitches the fly body and is provided on the table; and a clamping device conveying device which conveys the clamping device in a state where the fly is sandwiched by the clamping device in the cooperation with the table. The clamping device conveying device continuously performs: pre-edge-stitching conveyance, in which the clamping device is linearly conveyed toward the sewing machine in a state where the fly is sandwiched before edge stitching; and edge stitching conveyance, in which the clamping device is conveyed in accordance with a shape of an edge of the fly body in a state where the fly is sandwiched during the edge stitching. In addition, in the edge stitching conveyance, the clamping device is conveyed in accordance with a shape of the curved side.

As for the edge stitching conveyance of the clamping device conveying device, it does not matter whether other conveyance is performed after conveying the clamping device in accordance with the shape of the curved side. However, in order to improve quality of the edge stitching, it is desirable to perform as follows.

That is, in the edge stitching conveyance, the clamping device is continuously conveyed in accordance with the shape of the curved side and a shape of the vertical side.

The device which conveys the fly is not limited to the clamping device conveying device. The following is a specific example of conveyance of the fly.

That is, the sewing machine includes a dedicated conveying unit which conveys the fly. After the clamping device conveying device conveys the clamping device in accordance with the shape of the curved side, the dedicated conveying unit conveys the fly in accordance with the shape of the vertical side.

The clamping device is preferable to be as follows.

That is, the clamping device includes a holder which presses the fly, and a holder driving unit which moves the holder toward and away from an upper surface of the table. The holder includes a tape pressing unit which presses a tape of the slide fastener.

In order to stabilize a posture of the fly when the holder presses the fly, the holder is desirable to be as follows.

That is, the holder includes a stopper pressing unit which presses a stopper of the slide fastener.

The stopper pressing unit is preferable to be as follows.

That is, the stopper pressing unit includes an upper pressing unit which presses from above so as to sandwich the stopper in cooperation with the table, and a side pressing unit which presses the stopper from a width direction side.

The above described edge stitching device for the fly according to the present invention relates to conveying the fly while pressing the fly, the following conveying device for the fly of the present invention relates to preventing the tape of the fly from interfering with the edge stitching.

That is, the conveying device for the fly according to the present invention includes: a table on which the fly is placed; a sewing machine, which is provided on the table and edge-stitches the fly, the sewing machine including a sewing machine foot which sandwiches the fly in cooperation with the table; a pre-edge-stitching conveying device, which linearly conveys the fly on the table toward the sewing machine before edge stitching; an edge stitching conveying device, which conveys the fly in accordance with a shape of an edge of the fly body during the edge stitching; and a tape separating device, which moves one end portion on an edge stitching side in a longitudinal direction of a tape of the slide fastener above the sewing machine foot and away from the fly body on the table before the edge stitching.

Specific examples of the tape separating device are following 1) to 3).

1) The tape separating device includes an insertion piece configured to be inserted between the fly body and the tape, and an insertion piece driving unit, which moves the insertion piece to a first position between the fly body and the tape and a second position away from a position between the fly body and the tape.

2) The tape separating device is a suction device which suctions the tape.

3) The tape separating device is a chuck device which grasps the tape from above.

Advantageous Effects of Invention

Since the edge stitching device for the fly according to the present invention continuously performs the pre-edge-stitching conveyance and the edge stitch conveyance while the fly is sandwiched by the clamping device, the posture of the fly with respect to the clamping device can be keep constant as compared with a case where the pre-edge-stitching conveyance and the edge stitch conveyance are performed by separate devices, and the quality of the edge stitching of the fly can be improved.

According to the edge stitching device for the fly, the clamping device is continuously conveyed in accordance with the shape of the curved side and the shape of the vertical side in the edge stitching conveyance, thus the quality of the edge stitching of the fly can be improved in a range of the curved side portion and the vertical side portion.

According to the edge stitching device for the fly, the holder of the clamping device includes the tape pressing unit, a thickness of a pressed portion of the fly is thicker as compared with a case where the fly body is pressed, so it is easier to perform the pressing, and the posture of the fly can be stabilized when pressing by the holder.

According to the edge stitching device for the fly, the holder includes the stopper pressing unit, there are more portions for pressing the fly as compared with a case where the fly is only pressed by the tape pressing unit, so the posture of the fly can be stabilized when pressing by the holder.

According to the edge stitching device for the fly, the stopper pressing unit includes the upper pressing unit and the side pressing unit, there are more portions for pressing the stopper, so the posture of the fly can be stabilized when pressing by the holder.

The edge stitching device for the fly includes the tape separating device, since one end portion of one tape of the slide fastener is moved above the sewing machine foot and away from the fly on the table before the edge stitching, the one end portion of the tape is passed above the sewing machine foot during the edge stitching, so that the tape does not interfere with the edge stitching of the fly.

DESCRIPTION OF EMBODIMENTS

Figure 1:
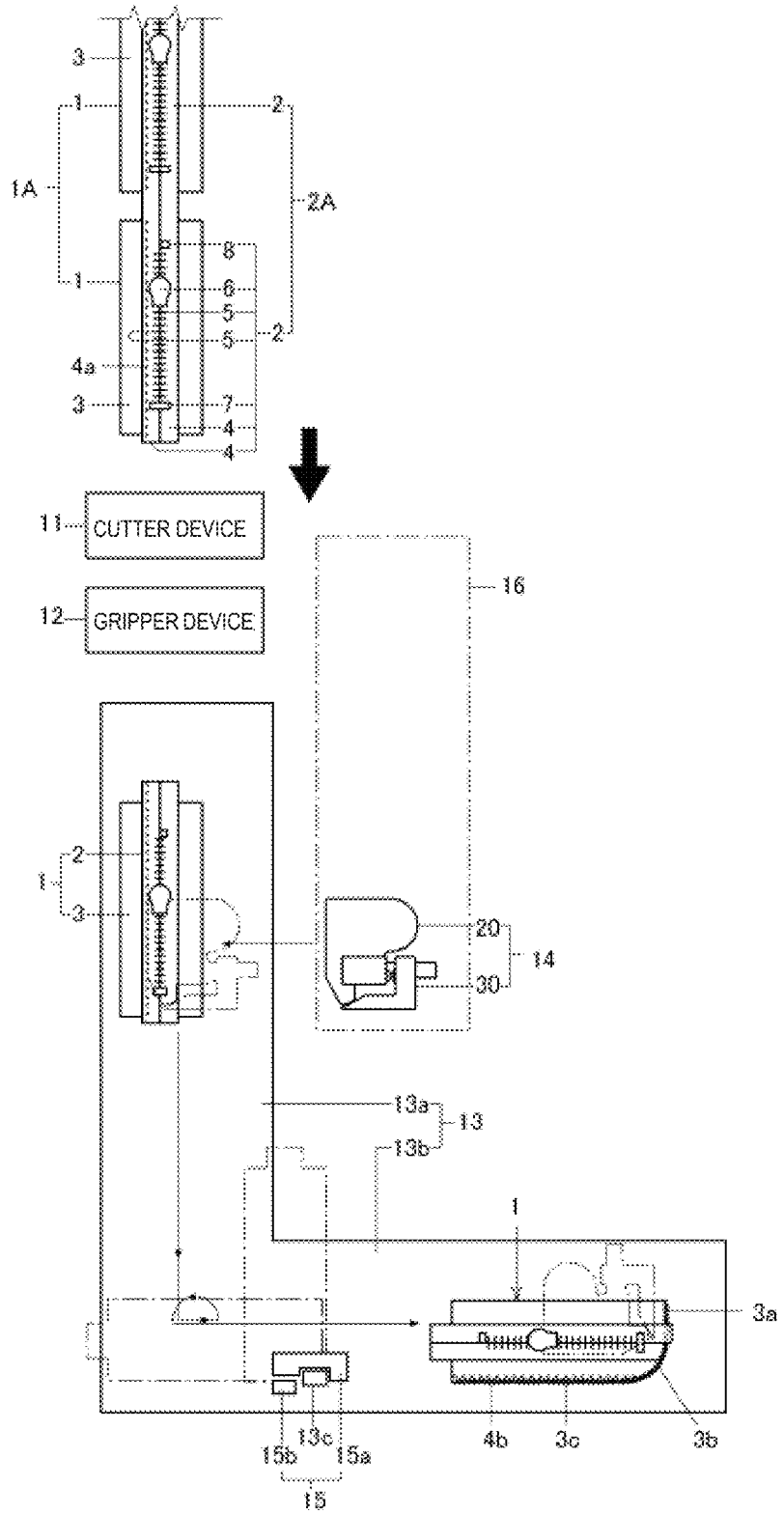
FIG. 1 is a plan view showing an edge stitching device for a fly according to a first embodiment of the present invention.

A fly is an object to be stitched by an edge stitching device for the fly according to a first embodiment of the present invention. As shown in FIG. 1, a fly 1 is a part of a long object 1A in a stage before the fly becomes the object to be stitched. The long object 1A is formed by continuously arranging a plurality of flies 1 in a longitudinal direction thereof. The long object 1A is cut at a position between adjacent flies 1, 1 so as to form the fly 1.

In other words, the long object 1A includes a long fastener chain 2A, and a plurality of fly bodies 3 that are superposed below the fastener chain 2A and are sewn with intervals therebetween in a longitudinal direction of the fastener chain 2A.

The fastener chain 2A is formed by continuously arranging a plurality of slide fasteners 2 in the longitudinal direction thereof. The fastener chain 2A is cut at a position between adjacent slide fasteners 2, 2 so as to form the slide fastener 2. By cutting in this way, the fly 1 is formed, in which the slide fastener 2 and the fly body 3 below are integrated.

The slide fastener 2 has an elongated shape. Therefore, the slide fastener 2 has a longitudinal direction and a width direction orthogonal to each other in addition to a thickness direction. A width direction length of the slide fastener is shorter than a longitudinal direction length of the slide fastener.

The slide fastener 2 includes: a pair of tapes 4, 4 disposed to face each other in the width direction; a pair of element rows 5, 5 fixed to side edge portions, which face each other in the width direction, of the pair of tapes 4, 4; a slider 6 that is movably guided with respect to the pair of element rows 5, 5 and opens and closes the pair of element rows 5, 5; and first and second stoppers 7, 8 that stop movement of the slider 6 at two longitudinal direction ends of the pair of element rows 5, 5.

A side edge portion, which is opposite to a facing side edge portion in the width direction, of one of the pair of tapes 4, 4 is sewn to the fly body 3 by sewing thread 4*a* along the longitudinal direction, and the other one of the pair of tapes 4, 4 is simply overlapped with the fly body 3 without being sewn to the fly body 3. Hereinafter, the tape 4 sewn by the sewing thread 4*a* may be referred to as the sewn side tape 4, and the tape 4 which is not sewn may be referred to as the non-sewn side tape 4 for distinguishing.

The first stopper 7 collides with the slider 6 when the slider 6 is moved in a direction in which the pair of element rows 5, 5 is opened. The first stopper 7 is fixed to the pair of tapes 4, 4, and connects the pair of tapes 4, 4.

The second stopper 8 collides with the slider 6 when the slider 6 is moved in a direction in which the pair of element rows 5, 5 is closed. The second stopper 8 is fixed to one tape 4.

The element row 5 is formed of a plurality of elements arranged in a row with intervals therebetween, the plurality of elements being fixed to the tape along the longitudinal direction on a facing side edge portion side thereof, or formed of a monofilament bent in a coil shape or a zigzag shape, the monofilament including continuous element portions corresponding to the plurality of elements.

Figure 2:
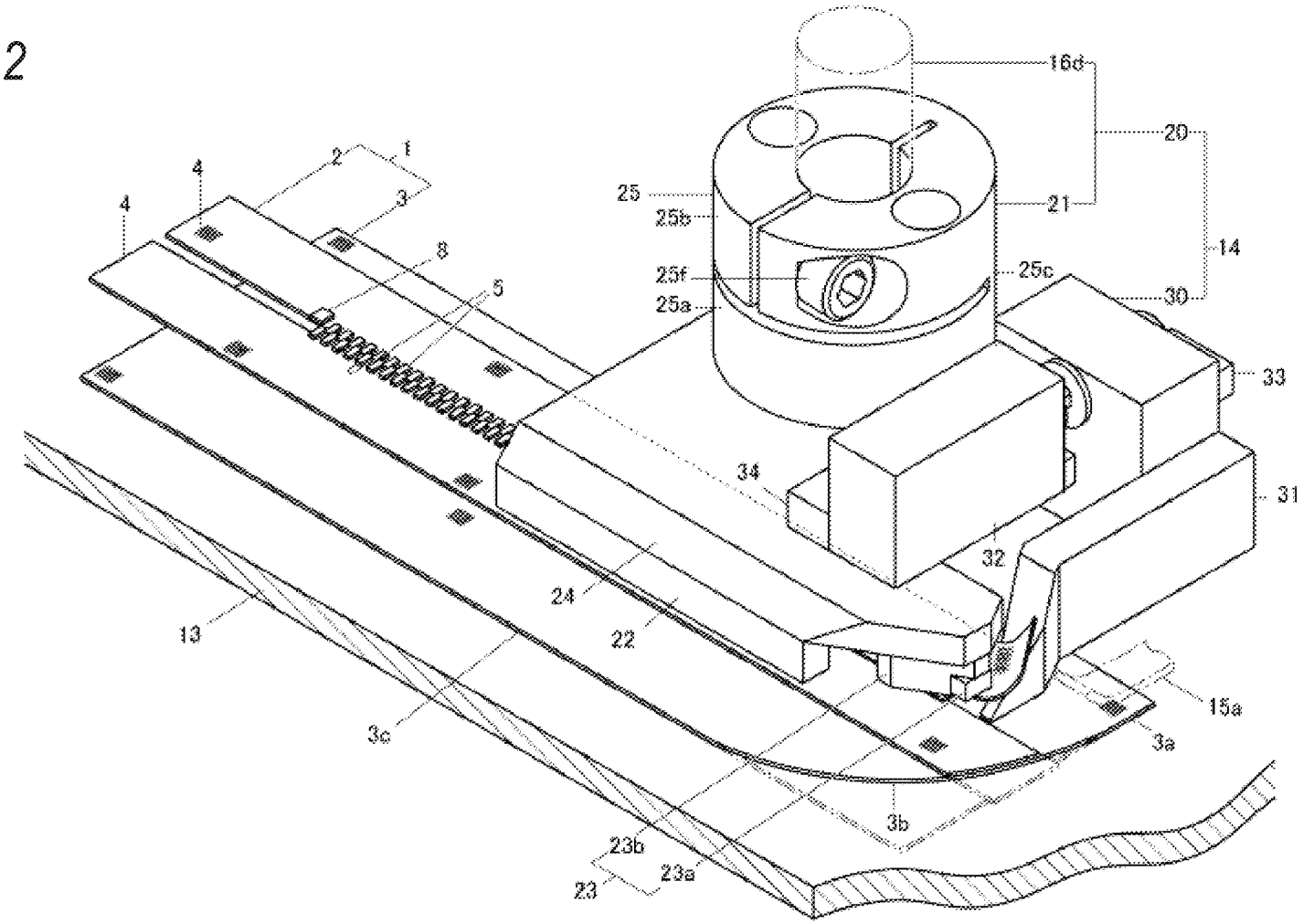
FIG. 2 is a perspective view showing a use state of a posture maintenance device of the edge stitching device for the fly according to the first embodiment as viewed from above.
Figure 3:
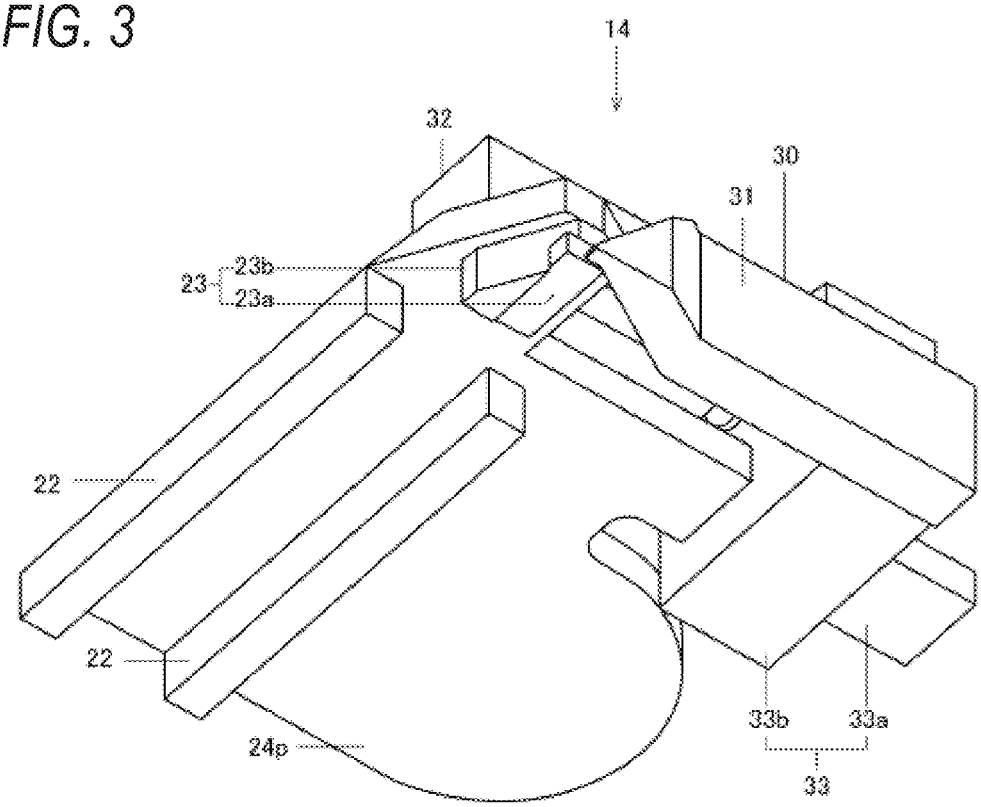
FIG. 3 is a perspective view showing the posture maintenance device as viewed from below.

The fly body 3 is a flexible fabric. In the present embodiment, the fly body 3 has a rectangular shape, and includes two sides facing each other in one direction and two sides facing each other in another direction. More specifically, the fly body 3 has an elongated rectangular shape, and includes two long sides and two short sides. The fly body 3 includes four corner portions. As shown in FIG. 2, the fly body 3 is cut into a shape in which one of the four corner portions is smoothly curved before edge stitching (stitching of edges).

The cut corner portion among the four corner portions is, with respect to a direction in which the short side extends (hereinafter referred to as a short side direction), a corner portion located on the side of a direction in which the sewn side tape 4 sewn to the upper slide fastener 2 is located, and a corner portion located on the side where the first stopper 7 is located, with respect to a direction in which the long side extends (hereinafter referred to as a long side direction). In addition to the fly body 3, the sewn side tape 4 is also cut together with the fly body 3.

The smoothly curved shape is a locus corresponding to ¼ of a circle in an illustrated example, that is, a circular arc shape. Although not shown, a locus corresponding to ¼ of an ellipse, that is, an elliptic arc shape, is also included in the smoothly curved shape. A center of the circle or the ellipse is located on the side of the fly body, and tangents of two ends of the circular arc shape or the elliptic arc shape are the long side and the short side located on two sides thereof.

Hereinafter, terms related to edges of the fly body is defined as follows. A portion of the smoothly curved shape is referred to as a curved side 3*b*. A long side, which is a tangent to one end of the curved side 3*b*, is referred to as a vertical side 3*c*. A short side, which is a tangent to the other end of the curved side 3*b*, is referred to as a horizontal side 3*a*. Therefore, a portion of an edge of the fly body 3 is formed by smoothly joining the curved side 3*b* with the horizontal side 3*a* and the vertical side 3*c* that extend straight in an intersecting direction, more specifically, an orthogonal direction. The edge of the fly body 3 is formed by the long sides, the short sides, the vertical side 3*c*, the horizontal side 3*a*, and the curved side 3*b*.

A long side direction length of the fly body 3 is shorter than the longitudinal direction length of the slide fastener 2, while a short side direction length is longer than the width direction length of the slide fastener 2. Since the slide fastener 2 is superposed on a short side direction middle portion of the fly body 3, two short side direction (a direction in which the horizontal side 3*a* extends) end portions of the fly body 3 protrudes from two width direction sides of the slide fastener 2. Two longitudinal direction end portions of the slide fastener 2 protrude from two long side direction sides of the fly body 3. A protruding length of the slide fastener 2 in the longitudinal direction on the first stopper 7 side is shorter than a protruding length on the second stopper 8 side. Therefore, with respect to the first stopper 7 side, one longitudinal direction end of the pair of tapes 4, 4 and one long side direction end (one end on the horizontal side 3*a* side) of the fly body 3 are substantially in the same position. The long side direction (the extending direction of the vertical side 3*c*) of the fly body 3 is aligned with the longitudinal direction of the slide fastener 2. The alignment is not strictly limited as long as the directions can be determined to be parallel when visually observed.

The edge stitching device for the fly according to the first embodiment of the present invention is configured to stitch the fly 1 described above. As shown in FIG. 1, the edge stitching device for the fly according to the first embodiment includes: a long object conveying device (not shown) which conveys a long object 1A in a longitudinal direction thereof; a cutting device 11 which cuts the conveyed long object 1A at a position between adjacent flies 1, 1; a gripper device 12 which grips and carries the fly 1 cut off from the long object 1A; a table 13 on which the fly 1 carried by the gripper device 12 is placed; a posture maintenance device 14 which maintains a posture of the fly 1 on the table 13 for edge stitching; a sewing machine 15 which edge-stitches the fly body 3 and is placed on the table 13; a posture maintenance device conveying device 16 which conveys the posture maintenance device 14 together with the fly 1.

An upper surface of the table 13 is a flat surface. The table 13 has an L-shape in a plan view, and includes two plate portions 13*a*, 13*b* extending in directions orthogonal to each other. The sewing machine 15 is disposed at a portion where the two plate portions 13*a*, 13*b* intersect. A portion of the table 13 where the sewing machine 15 is disposed is formed with a through hole 13*c* penetrated in a thickness direction of the plate. A portion of a feed dog (not shown) serving as a conveying unit for conveying the fly 1 is disposed in the through hole 13*c*. The feed dog conveys the fly 1 in accordance with up-down movement of a sewing machine needle (not shown) of the sewing machine 15.

Hereinafter, directions are defined as follows. The directions orthogonal to each other in the L-shape when the table 13 is viewed in a plan view (directions in which the two plate portions 13*a*, 13*b* extend) are referred to as two orthogonal linear directions. One linear direction is referred to as a front-rear direction, and the other linear direction is referred to as a left-right direction. The front-rear direction is an up-down direction in FIG. 1. A front direction is a downward direction in FIG. 1, and a rear direction is an upward direction in FIG. 1. The left-right direction is a left-right direction in FIG. 1. A left direction is a left direction in FIG. 1, and a right direction is a right direction in FIG. 1.

The sewing machine 15 includes: a sewing machine foot 15*a* which is supported above the table 13 so as to be movable upward and downward, and presses the fly 1 in cooperation with the table 13; a sewing machine needle which moves up and down; a feed dog which carries the fly 1; and a cutter 15*b* which is disposed around the sewing machine foot 15*a* in a plan view and cuts the fly 1.

The sewing machine foot 15*a* has a plate shape. The sewing machine foot 15*a* extends along one linear direction among the orthogonal directions of the table 13 in a plan view, and extends along the left-right direction in the illustrated example. One side portion (a portion on a downstream side in a direction in which the fly 1 is conveyed) 15*a*1 of the one linear direction is a portion that presses the fly, and the other side portion (a portion on an upstream side in the direction in which the fly 1 is conveyed) 15*a*2 of the one linear direction is a portion that guides the fly 1 to the one side portion 15*a*1. The other side portion 15*a*2 is shaped to extend upward (extending away from the one side portion 15*a*1) toward the other side (upstream).

Figure 8:
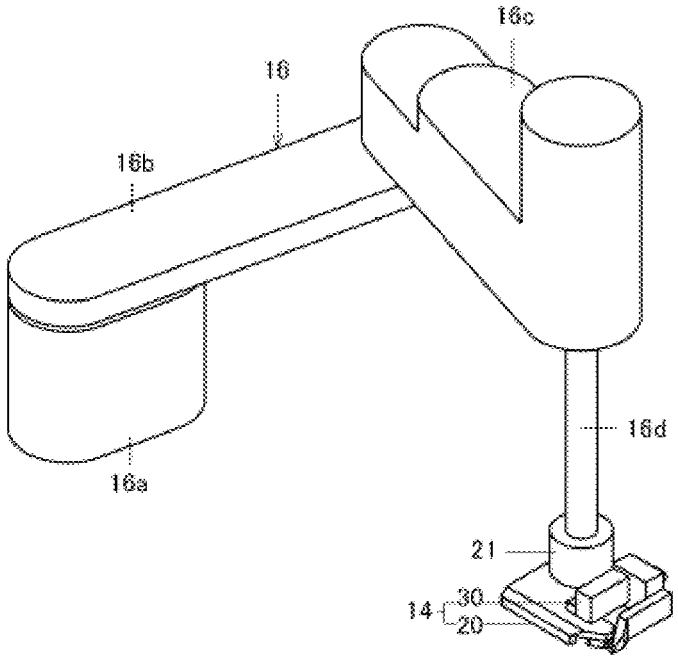
FIG. 8 is a perspective view showing the posture maintenance device and a posture maintenance device conveying device.

As shown in FIG. 8, the posture maintenance device conveying device 16 is a four-shaft multi-joint robot 16. More specifically, the multi-joint robot 16 includes: a fixed portion 16*a* fixed to a frame (not shown) disposed around the table 13; a first link portion 16*b* which has one end portion disposed above the fixed portion 16*a*, and is rotatably supported with respect to the fixed portion 16*a* with a vertical first shaft (not shown) serving as a fulcrum; a second link portion 16*c* which has one end portion disposed above the other end portion of the first link 16*b*, and is rotatably supported with respect to the first link portion 16*b* with a vertical second shaft (not shown) serving as a fulcrum; and a rod 16*d* hanging from the other end portion of the second link portion 16*c*, which is rotatably (spinnable) supported around a vertical third shaft (not shown) serving as a centerline thereof. The multi joint robot 16 includes a driving unit (not shown) configured to rotate the first and second link portions 16*b*, 16*c* with the first and second shafts serving as the fulcrum, and a driving unit (not shown) configured to rotate the rod 16*d*.

The multi joint robot 16 includes an elevation driving unit (not shown) configured to drive the rod 16*d* to enable up-down movement thereof. The elevation driving unit lifts and lowers the rod 16*d* by a portion that rotates around a horizontal fourth shaft (not shown) serving as a fulcrum. The rod 16*d* and the elevation driving unit constitute a portion of the posture maintenance device 14 (a driving unit of a clamping device 20 described below). A body portion of the posture maintenance device 14 (portions of the clamping device 20 excluding the driving unit) is fixed to a lower end portion of the rod 16*d*.

As shown in FIG. 1, the multi-joint robot 16 continuously performs: pre-edge-stitching conveyance, in which the posture maintenance device 14 (the clamping device 20) is linearly conveyed toward the sewing machine 15 in a state where the fly 1 is sandwiched before edge stitching; and edge stitching conveyance, in which the posture maintenance device 14 (the clamping device 20) is conveyed in accordance with the shape of the edge of the fly body 3 in a state where the fly 1 is sandwiched during the edge stitching. That is, the multi joint robot 16 is formed by integrating a pre-edge-stitching conveying device and an edge stitching conveying device.

The pre-edge-stitching conveyance is linear conveyance from the rear side to the front side. An end portion of the fly 1 on the first stopper 7 side in the longitudinal direction is conveyed around the sewing machine foot 15*a* toward an upstream side (a left side in FIG. 1) of the sewing machine foot 15*a*.

The edge stitching conveyance is conveyance configured to continuously edge-stitch the edge portion of the fly 1 in accordance with shapes of the horizontal side 3*a*, the curved side 3*b*, and the vertical side 3*c* sequentially.

The conveyance configured to perform edge stitching in accordance with the shape of the horizontal side 3*a* and the conveyance configured to perform edge stitching in accordance with the shape of the vertical side 3*c* are linear conveyance toward the left side in FIG. 1.

The conveyance configured to perform edge-stitching in accordance with the shape of the curved side 3*b* is a conveyance along a rotation direction which substantially draws a semicircle in a plan view.

As shown in FIG. 2 to FIG. 6, the posture maintenance device 14 includes: the clamping device 20 which sandwiches the fly 1 in cooperation with the table 13; and a tape separating device 30 which moves one edge stitching side (first stopper side) end portion of the tape 4, which is an end portion in the longitudinal direction of the tape 4 on the non-sewn side, above the sewing machine foot 15*a* and away from the fly body 3 on the table 13 before the edge stitching.

The clamping device 20 includes a holder 21 serving as a clamping device body portion which presses the fly 1, and a holder driving unit which moves the holder 21 toward and away from the fly 1 on the table 13 in the thickness direction (up-down direction) of the tape 4. As described above, the holder driving unit is a portion of the multi-joint robot 16 (the rod 16*d* and the elevation driving unit which lifts and lowers the rod 16*d*).

The holder 21 includes: two tape pressing units 22, 22 which press the two tapes 4, 4 of the slide fastener 2 separately; a stopper pressing unit 23 which presses the first stopper; a holder plate 24 which fixes the two tape pressing units 22, 22 and the stopper pressing unit 23; and a connecting unit 25 which connects the holder plate 24 and the rod 16*d*. In the holder 21, the connecting unit 25 is provided on one surface side in a thickness direction of the holder plate 24, while the two tape pressing units 22, 22 and the stopper pressing unit 23 are provided on the other surface side in the thickness direction of the holder plate 24. The two tape pressing units 22, 22 are disposed parallel to each other with an interval therebetween, and the stopper pressing unit 23 is disposed on an extension line of the interval.

Hereinafter, directions of the holder 21 will be described with reference to an initial state in which the fly 1 is pressed on the table 13.

The connecting unit 25 includes: a first connecting unit 25*a* connected to an upper surface of the holder plate 24; a second connecting unit 25*b* connected to a lower end portion of the rod 16*d*; and a joining unit 25*c* which is disposed between the first connecting unit 25*a* below and the second connecting unit 25*b* above and joins the first connecting unit 25*a* and the second connecting unit 25*b*.

The first connecting unit 25*a* accommodates a portion of the rod 16*d* on an inner surface thereof, and has a cylindrical shape penetrated in the up-down direction.

The second connecting unit 25*b* is a split fastening mechanism. The second connecting unit 25*b* has a C shape in a plan view, and accommodates a portion of the rod 16*d* on an inner surface side in an aperture direction. The second connecting unit 25*b* includes through holes 25*d*, 25*e* which are penetrated in a direction in which two peripheral direction end portions of the C shape face each other. The second connecting unit 25*b* narrows an aperture of the C shape by connecting the two peripheral direction end portions of the C shape with a screw pair using the through holes 25*d*, 25*e*, and fastens the rod 16 to the inner surface side in the aperture direction. In the illustrated example, the screw pair includes a female screw formed in the through hole 25*e* and a bolt 25*f* screwed to the female screw.

The joining unit 25*c* joins a peripheral direction middle portion of the C shape of the second connecting unit 25*b* and the first connecting unit 25*a* in the up-down direction.

The tape pressing unit 22 has a rod shape (more specifically, a cornered rod shape), and a lower surface thereof faces an upper surface of the table 13. The lower surface is a flat surface parallel to the upper surface of the table 13.

The thickness direction of the holder plate 24 is the up-down direction, and a lower surface of the holder plate 24 is a surface facing the upper surface of the table 13. When viewed from below, the holder plate 24 includes two orthogonal surfaces 24*a*, 24*b*, among which the left side surface 24*a* is a surface parallel to the front-rear direction, and the other rear surface 24*b* is a surface parallel to the left-right direction. The holder plate 24 includes: a front surface 24*c* whose left-right direction length is shorter than the rear surface 24*b*, the front surface 24*c* being parallel to the left-right direction; and an inclined surface 24*d* connecting front surface 24*c* and the left side surface 24*a*. The inclined surface 24*d* is a surface facing rightward toward the front. Therefore, the holder plate 24 has a shape in which a corner portion, where the front surface 24*c* and the left side surface 24*a* intersect, is chamfered.

The holder plate 24 is fixed in a state where the tape pressing units 22, 22 are arranged in parallel to the lower surface of the holder plate 24. More specifically, the two tape pressing units 22, 22 are arranged in parallel to one of two surfaces (left side surface 24*a*) orthogonal to the lower surface of the holder plate 24, and the left side surface 24*a* is aligned so as to be flush with a left side surface of one tape pressing portion 22. The other surface of the two surfaces (rear surface 24*b*) orthogonal to the lower surface of the holder plate 24 is aligned so as to be flush with rear surfaces of the two tape pressing units 22, 22. Front-rear direction lengths of the two tape pressing units 22, 22 are different. Among the two tape pressing units 22, 22, the tape pressing unit 22 which is aligned with a side surface of the holder plate 24 has a longer front-rear direction length than the other tape pressing unit 22, and a front end portion thereof protrudes forward with respect to the other tape pressing unit 22.

The two rod-shaped tape pressing units 22, 22 are spaced apart from each other in a direction orthogonal to an extending direction of the rod (the left-right direction), and an interval therebetween is set such that edge portions opposite to facing side edge portions of the pair of tapes 4, 4 (side edge portions on which the element rows 5, 5 are located) are pressed. The stopper pressing unit 23 is fixed to a portion of the lower surface of the holder plate 24 that is away from the interval in the front.

The stopper pressing unit 23 includes an upper pressing unit 23*a* which presses from above so as to sandwich the first stopper 7 in cooperation with the table 13, and a side pressing unit 23*b* which presses the first stopper 7 from a width direction side (curved side 3*b* side).

Figure 6:
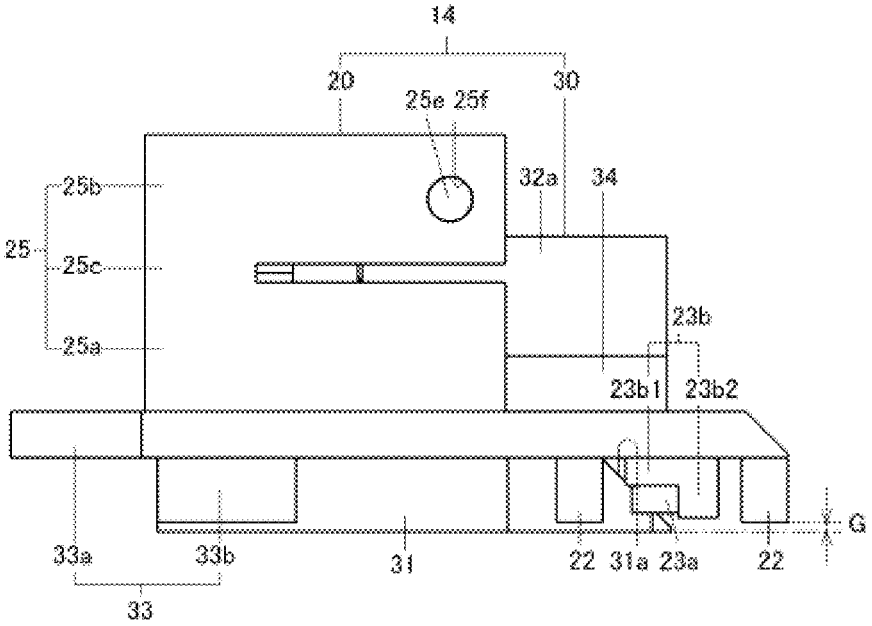
FIG. 6 is a rear view of the posture maintenance device.

As shown in FIG. 6, the side pressing unit 23*b* is L-shaped when viewed from the front-rear direction, and includes a fixing piece 23*b*1 fixed to the lower surface of the holder plate 24, and a hanging piece 23*b*2 hanging downward from a left end portion (right end portion of the fixing piece 23*b*1 in FIG. 6 as viewed from the rear) of the fixing piece 23*b*1.

Figure 5:
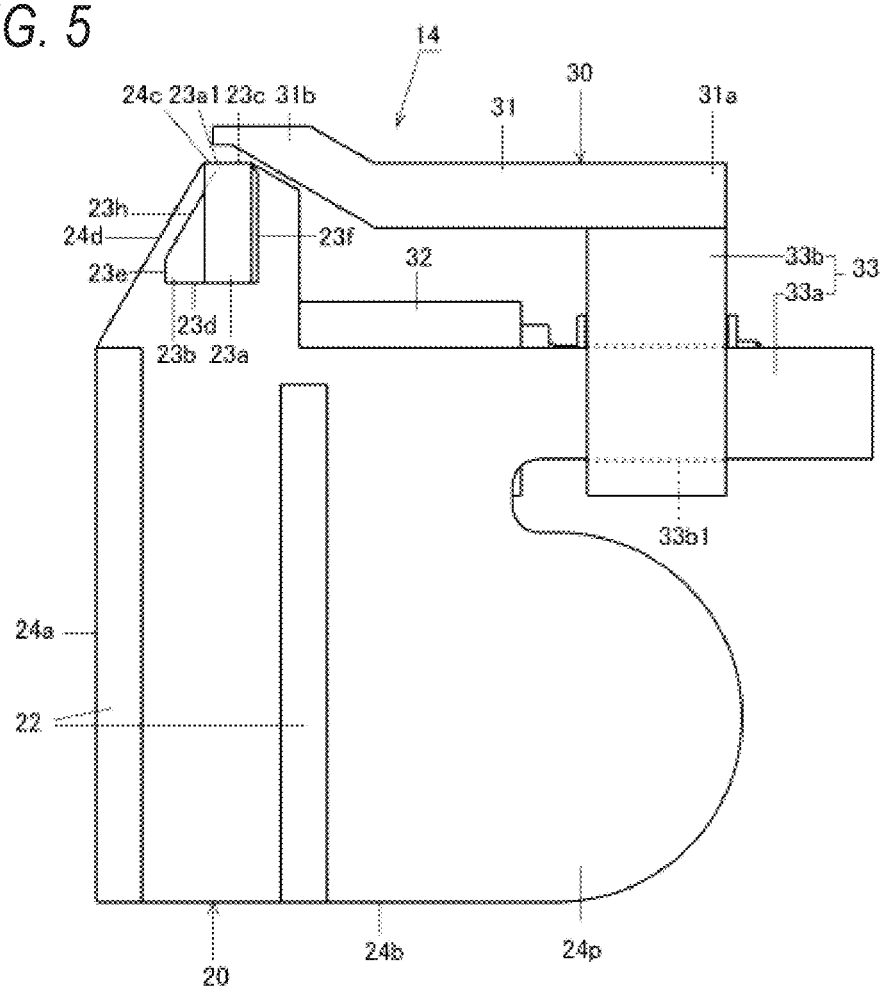
FIG. 5 is a bottom view of the posture maintenance device.

As shown in FIG. 5, the side pressing unit 23*b* has a non-rectangular shape when viewed from below. More specifically, the side pressing unit 23*b* includes: a front surface 23*c* and a rear surface 23*d* which extend in the left-right direction and are parallel to each other; a left side surface 23*e* and a right side surface 23*f* which extend in the front-rear direction and are parallel to each other; and an inclined surface 23*h* that obliquely connects the front surface 23*c* and the left side surface 23*e*.

The inclined surface 23*h* is a surface facing rightward toward the front. The inclined surface 23*h* is formed over the fixing piece 23*b*1 and the hanging piece 23*b*2. Therefore, the side pressing unit 23*b* has a shape in which a corner portion, where the front surface 23*c* and the left side surface 23*e* intersect, is chamfered. When viewed from below, the inclined surface 23*h* of the side pressing unit 23*b* is arranged in parallel to the inclined surface 24*d* of the holder plate 24 on a center portion side of the holder plate 24.

The upper pressing unit 23*a* is a rectangular parallelepiped block, and a lower surface thereof is a flat surface parallel to the upper surface of the table 13. A lower surface of the upper pressing unit 23*a* is rectangular, and more specifically, a front-rear direction length thereof is longer than a left-right direction length thereof. A front surface 23*a*1 of the upper pressing unit 23*a* is aligned so as to be flush with the front surface 24*c* of the holder plate 24. The lower surface of the upper pressing unit 23*a* is located above a lower surface of the side pressing unit 23*b* (the hanging piece 23*b*2), and the lower surface of the side pressing unit 23*b* (the hanging piece 23*b*2) is located above a lower surface of the tape pressing unit 22.

As for the material of the holder 21 described above, the tape pressing unit 22 and the upper pressing unit 23*a* are made of, for example, resin (preferably made of resin having elasticity), while the other portions (the holder plate 24, the connecting unit 25, and the side pressing unit 23*b*) are made of metal, for example.

As shown in FIGS. 2 to 6, the tape separating device 30 includes: an insertion piece 31 configured to be inserted between the fly 1 and the tape 4; an insertion piece driving unit 32 which moves the insertion piece 31 and is fixed to the holder plate 24; and a guide 33 which movably guides the insertion piece 31 and stabilizes a movement direction of the insertion piece 31.

The guide 33 includes a guide rail 33*a* which extends in a straight line, and a movable element 33*b* which is movable along the guide rail 33*a*. The movable element 33*b* includes a through hole 33*b*1 through which the guide rail 33*a* is passed. A penetration direction of the through hole 33*b*1 coincides with the left-right direction, which is an extending direction of the guide rail 33*a*.

The guide rail 33*a* is a portion of the holder plate 24. That is, the holder plate 24 includes: a fixing plate portion 24*p* configured to fix the other components of the holder 21 (the tape pressing unit 22, the stopper pressing unit 23 and the connecting unit 25) and the insertion piece driving unit 32; and the guide rail 33*a* protruding laterally with respect to the fixing plate portion 24*p*.

Figure 4:
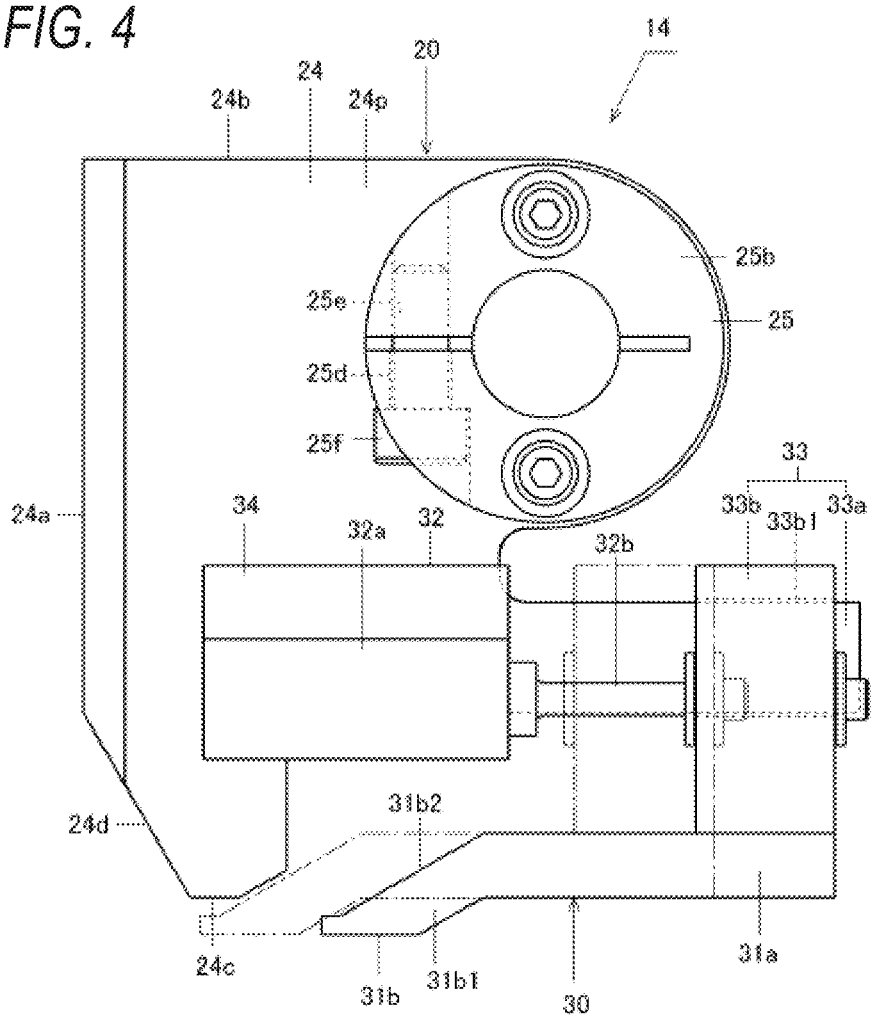
FIG. 4 is a plan view of the posture maintenance device.

The insertion piece driving unit 32 is a cylinder device, and includes: a cylinder case 32*a* fixed to the upper surface of the holder plate 24; a piston (not shown) which is capable of reciprocating along an inner surface of the cylinder case 32*a*; and a piston rod 32*b* which protrudes outward from the inside of the cylinder case 32*a* and is fixed to the piston, as shown in FIG. 4. The insertion piece driving unit 32 includes a block 34 which is fixed to the upper surface of the holder plate 24 so as to be adjacent to the cylinder case 32*a*. The cylinder case 32*a* is fixed to the block 34. Accordingly, the cylinder case 32*a* is fixed to the holder plate 24.

The piston rod 32*b* includes a movable element 33*b*, which is fixed to a tip end portion of the piston rod 32*b* protruding to the outside of the cylinder case 32*a*. The insertion piece 31 is fixed to the movable element 33*b*, and the insertion piece 31 is disposed in front of the holder plate 24. The insertion piece driving unit 32 linearly reciprocates the insertion piece 31 in a direction intersecting a direction of an extension line of an interval for the element row (more specifically, an orthogonal direction) while being parallel to the upper surface of the table 13. One of limit positions of a movement range when the insertion piece 31 linearly reciprocates is a position between the non-sewn side tape 4 and the fly body 3 of the fly 1 (more specifically, the fly 1 pressed by the clamping device 20) on the table 13, and is referred to as a first position. The other limit position of the movement range when the insertion piece 31 linearly reciprocates is a position away from the first position, that is, a position laterally away from positions between the non-sewn side tape 4 and the fly body 3, and is referred to as a second position.

The insertion piece 31 extends in the left-right direction. A right end portion thereof, which is one end portion in the extending direction, serves as a fixed portion 31*a* fixed to the movable element 33*b*, while a left end portion thereof, which is the other end portion, serves as an insertion portion 31*b* inserted between the non-sewn side tape 4 and the fly body 3. A tip portion side of the insertion piece 31 refers to the insertion portion 31*b* side with respect to the side of the fixed portion.

The insertion portion 31*b* extends in the left-right direction in front of the tape pressing unit 22, more specifically, in front of the stopper pressing unit 23.

An upper surface 31*b*1 of the insertion portion 31*b* is an inclined surface whose tip end is inclined downward. A lower surface of the insertion portion 31*b* is parallel to the upper surface of the table 13. Therefore, a thickness of the insertion portion 31*b* in the up-down direction is gradually reduced toward the tip end. Moreover, as shown in FIG. 6, the lower surface of the insertion piece 31 (the insertion portion 31*b*) is lower by a gap G than lower surfaces of the tape pressing portion 22 and the movable element 33*b*. The gap G is set to be slightly shorter than a thickness of the tape 4.

In a plan view, a rear surface 31*b*2 on the holder plate side of the insertion portion 31*b* is an inclined surface that approaches the insertion piece driving unit 32 as extending in the right direction, which is a protruding direction of the piston rod 32*b*.

An edge stitching method of the edge stitching device according to the first embodiment described above is as the following processes 1) to 9). This edge stitching method will be described mainly with reference to FIG. 1.

1) First, the long object 1A is conveyed in the longitudinal direction thereof by the long object conveying device (not shown) and is directed toward the table 13.

2) Next, the cutter device 11 cuts the long object 1A at the position between the adjacent flies 1, 1.

3) The gripper device 12 grips the fly 1 cut off from the long object 1A, conveys the fly 1 toward the table 13, and places the fly 1 on the table 13. More specifically, the fly 1 is placed on a front portion of the plate portion 13*a* of the table 13 extending in the front-rear direction. At this time, the posture maintenance device 14 stands by at a position laterally and upwardly away from the front portion of the table 13.

4) The multi joint robot 16 moves the posture maintenance device 14 onto the fly 1 and lowers the posture maintenance device 14, so that the posture maintenance device 14 (the clamping device 20) sandwiches the fly 1 in cooperation with the table 13. At this time, the pair of tapes 4, 4 of the fly 1 is pressed separately by the tape pressing units 22, so that the fly body 3 and the tape 4 are sandwiched between each tape pressing unit 22 and the table 13. The first stopper 7 is pressed by the stopper pressing unit 23, so that the first stopper 7 is sandwiched between the upper pressing unit 23*a* and the table 13, and the first stopper 7 is brought into contact with the side pressing unit 23*b* laterally (on the upper pressing unit 23*a* side). At this time, the insertion piece 31 of the posture maintenance device 14 (the tape separating device 30) is placed on the fly body 3 at the second position (initial position) which is laterally (right side in FIG. 1) away from the non-sewn side tape 4.

Figure 7:
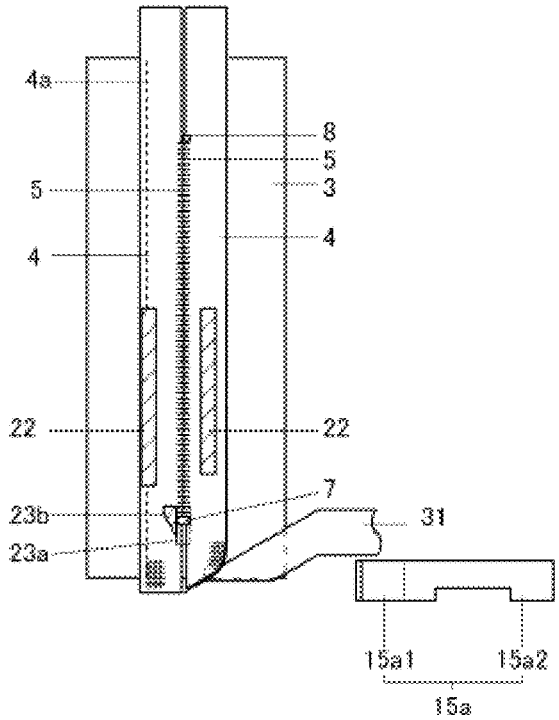
FIG. 7(A) is a plan view showing a state where a fly is pressed and one end portion of a tape is moved away upward.
FIG. 7(B) is a front view of the same.
FIG. 7(C) is a front view showing a relationship between the one end portion of the tape and a sewing machine foot.
Figure 7:
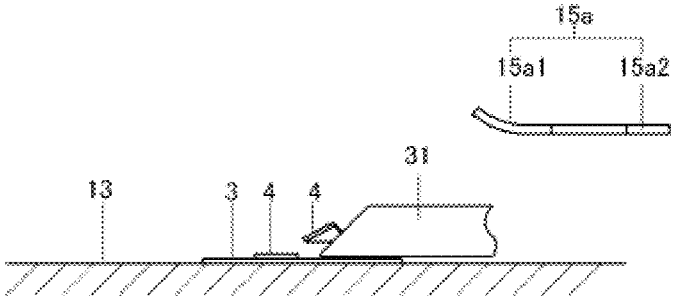
Figure 7:
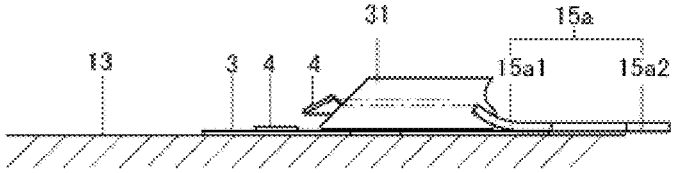

5) The posture maintenance device 14 (the tape separating device 30) drives the cylinder serving as the insertion piece driving unit 32, and as shown in FIGS. 7(A) and 7(B), the insertion portion 31*b* of the insertion piece 31 is inserted to the first position between the fly 1 and the non-sewn side tape 4. At this time, one end portion on the non-sewn side in the longitudinal direction of the non-sewn side tape 4, that is, an end portion on the first stopper side, is moved away from the fly body 3 before the edge stitching above the sewing machine foot 15*a*, as shown in FIG. 7(C). More specifically, as for the one end portion on the non-sewn side in the longitudinal direction of the non-sewn side tape 4, that is, the end portion on the first stopper side, an end of a lower surface thereof on the sewing machine foot 15*a* side in the width direction is moved away above an upper end of the sewing machine foot 15*a* (an upper end of the portion 15*a*2 of the sewing machine foot 15*a* located on an upstream side of the direction in which the fly 1 is conveyed).

6) The multi-joint robot 16 performs the pre-edge-stitching conveyance. That is, the multi joint robot 16 linearly conveys the posture maintenance device 14 (the clamping device 20) toward the sewing machine 15 in a state where the fly 1 is sandwiched before the edge stitching. As a result, the fly 1 is moved straight forward toward an intersecting portion of the L-shaped table 13, and the one edge stitching side end portion of the fly 1, that is, the end portion on the first stopper side, is disposed directly below the sewing machine foot 15*a* of the sewing machine 15. More specifically, the one end portion on the first stopper side of the fly 1 disposed directly below the sewing machine foot 15*a* is a portion of the fly body 3 that protrudes in the width direction from the pair of tapes 4, 4 and protrudes toward the sewn side tape 4 from the non-sewn side tape 4.

7) The sewing machine foot 15*a* is lowered to sandwich the fly body 3 in cooperation with the table 13.

8) The sewing machine 15 is started and the sewing machine needle moves up and down. The multi joint robot 16 performs the edge stitching conveyance.

8-1) First, the multi-joint robot 16 linearly conveys the posture maintenance device 14 (the clamping device 20) rightward in the state where the fly 1 is sandwiched before the edge stitching. As a result, the one end on the first stopper side of the non-sewn side tape 4 is passed above the sewing machine foot 15*a*, and the fly body 3 is edge-stitched along the horizontal side 3*a*.

8-2) Next, the multi joint robot 16 moves the posture maintenance device 14 in the state where the fly 1 is sandwiched so as to substantially draw a semicircle in a plan view. As a result, the cutter 15*b* adjacent to the sewing machine foot 15*a* cuts the one corner portion of the fly body 3 together with the sewn side tape 4, accordingly the curved side 3*b* of the fly body 3 is formed. The fly body 3 is edge-stitched along the curved side 3*b* together with the sewn side tape 4.

8-3) Next, the multi joint robot 16 linearly moves the posture maintenance device 14 in the state where the fly 1 is sandwiched rightward. As a result, the fly body 3 is edge-stitched along the vertical side 3*c*. Reference numeral 4*b* in FIG. 1 denotes edge-stitched sewing thread.

9) Up-down movement of the sewing machine needle stops, the sewing machine foot 15*a* is lifted, the multi joint robot 16 lifts the posture maintenance device 14 and returns the posture maintenance device 14 to the initial position, and the insertion piece driving unit of the tape separating device 30 is driven to return the insertion piece 31 to the second position which is the initial position. By repeating the above processes 1) to 9), the fly 1 is edge-stitched one after another.

The edge stitching device of the first embodiment has the following effects.

Since the edge stitching device according to the first embodiment continuously performs the pre-edge-stitching conveyance and the edge stitch conveyance while the fly 1 is sandwiched by the clamping device 20, the posture of the fly 1 with respect to the clamping device 20 can be keep constant as compared with a case where the pre-edge-stitching conveyance and the edge stitch conveyance are performed by separate devices, and quality of the edge stitching of the fly 1 can be improved.

In the edge stitching device according to the first embodiment, the clamping device 20 is continuously conveyed in accordance with shapes of the horizontal side 3*a*, the curved side 3*b* and the vertical side 3*c* during the edge stitching conveyance of the clamping device 20, thus the quality of the edge stitching of the fly 1 can be improved in an edge-stitched range (a range including portions of the horizontal side 3*a*, the curved side 3*b* and the vertical side 3*c*).

In the edge stitching device according to the first embodiment, the holder 21 of the clamping device 20 presses the tape 4 by the tape pressing unit 22, a thickness of a pressed portion of the fly 1 is thicker as compared with a case where the fly body 3 is pressed, so it is easier to perform the pressing, and the posture of the fly 1 can be stabilized when pressing by the holder 21. Moreover, in the edge stitching device according to the first embodiment, the fly 1 is presses against the two tapes 4, 4 by the pair of tape pressing units 22, 22, as compared with a case where the fly is pressed by one tape pressing unit, the posture of the fly 1 can be stabilized when pressing by the holder 21. A portion of the clamping device 20 which presses the pair of tapes 4, 4 is a lateral side of the pair of element rows 5, 5 in the longitudinal direction thereof.

In the edge stitching device according to the first embodiment, the holder 21 includes the stopper pressing unit 23, there are more portions for pressing the fly 1 as compared with a case where the fly is only pressed by the tape pressing unit 22, so the posture of the fly 1 can be stabilized when pressing by the holder 21.

In the edge stitching device according to the first embodiment, the stopper pressing unit 23 includes the upper pressing unit 23*a* and the side pressing unit 23*b*, there are more portions for pressing the first stopper 7, so the posture of the fly 1 can be stabilized when pressing by the holder 21. When the multi joint robot 16 rotates in a substantially semicircular shape so as to edge-stitch the curved side 3*b*, the side pressing unit 23*b* is disposed outward in a radial direction of the rotation, therefore the first stopper 7 tends to move outward in the radial direction of the rotation due to a centrifugal force. However, since the side pressing unit 23*b* stops this movement, the posture of the fly 1 can be stabilized during sewing.

Since the edge stitching device according to the first embodiment has a shape in which the holder plate 24 and the upper pressing unit 23*a* are chamfered, the holder plate 24 and the upper pressing unit 23*a* are less likely contact the sewing machine foot 15*a* during the rotation.

The edge stitching device according to the first embodiment includes the tape separating device 30, since one end portion on the first stopper side of the non-sewn side tape 4 is moved above the sewing machine foot 15*a* and away from the fly 1 on the table 13 before the edge stitching, the one end portion of the non-sewn side tape 4 is passed above the sewing machine foot 15*a* during the edge stitching, so that the non-sewn side tape 4 is not sewn when the fly 1 is edge-stitched, and the non-sewn side tape 4 does not interfere with the edge stitching of the fly 1. When the fly 1 is pressed by the clamping device 20, the end portion on the first stopper side of the non-sewn side tape 4 in the longitudinal direction is not pressed by the tape pressing unit 22 and the stopper pressing unit 23, and can be freely displaced in the thickness direction (the up-down direction) of the tape 4, so that the end portion can be displaced upward by the tape separating device 30.

Since the lower surface of the insertion piece 31 (the insertion portion 31*b*) is lower than the lower surface of the tape pressing unit 22, the insertion portion 31*b* is easily inserted between the non-sewn side tape 4 and the fly body 3.

In the edge stitching device according to the first embodiment, since the posture maintenance device 14 includes the clamping device 20 and the tape separating device 30, the pre-edge-stitching conveyance and the edge stitching conveyance can be performed together.

Edge stitching devices according to second and third embodiments of the present invention are different from the edge stitching device according to the first embodiment in the posture maintenance device. More specifically, in the posture maintenance device 14 according the first embodiment, the tape separating device 30 and the clamping device 20 are integrated, while in the posture maintenance devices according to the second and third embodiments tape separating devices and clamping devices are separated.

Figure 9:
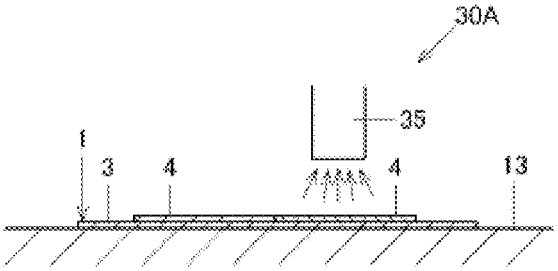
FIG. 9(A) and FIG. 9(B) are explanatory views showing another example of a clamping device of the posture maintenance device.
Figure 9:
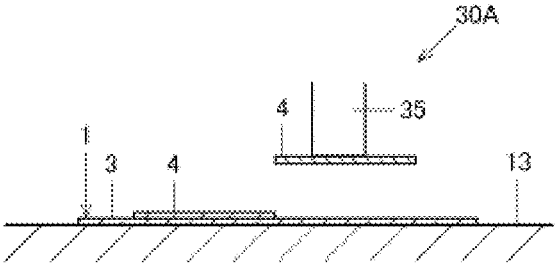

For example, FIG. 9 shows a tape separating device 30A of the edge stitching device according to the second embodiment. The tape separating device 30A is a suction device which suctions the tape 4 from above the table. More specifically, the tape separating device 30A includes a pipe 35 which suctions the non-sewn side tape 4 from a tip end thereof, and a blower (not shown) connected to the other end of the pipe 35. The blower discharges air suctioned from the pipe side to the outside. The edge stitching device according to the second embodiment includes a dedicated conveying device which performs the pre-edge-stitching conveyance and the edge stitching conveyance for the pipe 35 of the tape separating device 30A together with the clamping device.

Figure 10:
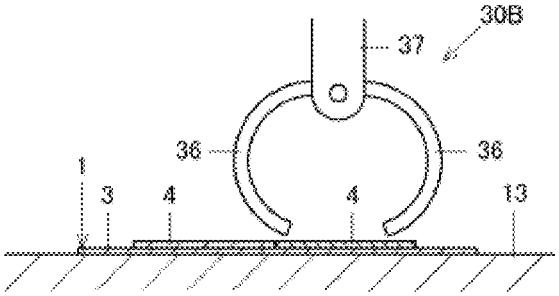
FIG. 10(A) and FIG. 10(B) are explanatory views showing another example of the clamping device of the posture maintenance device.
Figure 10:
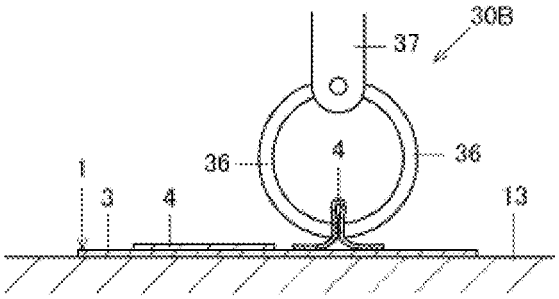

FIG. 10 shows a tape separating device 30B according to the third embodiment. The tape separating device 30B is a chuck device which grasps the tape 4 from above. More specifically, the tape separating device 30B includes: a pair of claw portions 36, 36 disposed above the table 13, the pair of claw portions 36, 36 grasping the non-sewn side tape 4 with lower end portions; a support portion 37 which supports the pair of claw portions 36, 36 so as to enable upper end portions thereof to be opened and closed; and a driving unit (not shown) which opens and closes the pair of claw portions 36, 36. The edge stitching device according to the third embodiment also includes a dedicated conveying device which performs the pre-edge-stitching conveyance and the edge stitching conveyance for the tape separating device 30B together with the clamping device.

The present invention is not limited to the above-described embodiments, and modifications can be made without departing from the scope thereof. For example, the fly body 3 serving as the object to be sewn is not limited to the one in which the vertical side 3*c* and the horizontal side 3*a* extend the orthogonal directions, the vertical side 3*c* and the horizontal side 3*a* may also extend in intersecting directions. The side facing the vertical side 3*c* of the fly body 3 in the width direction (long side) may not be parallel to the vertical side 3*c*. Similarly, the side facing the horizontal side 3*a* of the fly body 3 in the longitudinal direction (short side) may not be parallel to the horizontal side 3*a*.

Although the posture maintenance device conveying device is the multi-joint robot 16 in the above embodiments, the present invention is not limited thereto, and, for example, a rail disposed around the table and a driving device which drives the posture maintenance device along the rail may be provided.

Although the multi-joint robot 16 performs the edge stitching conveyance in the above embodiments, the present invention is not limited thereto, and the edge stitching conveyance may be performed by the feed dog (not shown) of the sewing machine 15. In this case, the feed dog is a dedicated conveying unit which conveys the fly 1. When the feed dog conveys the fly 1, the multi joint robot 16 moves the posture maintenance device 14 away from the fly 1.

REFERENCE SIGNS LIST

1A Long object
1 Fly
2A Fastener chain
2 Slide fastener
3 Fly body
3*a* Horizontal side
3*b* Curved side
3*c* Vertical side
4 Tape
4*a* Sewing thread
4*b* Sewing thread
5 Element row
6 Slider
7 First stopper
8 Second stopper
11 Cutter device
12 Gripper device
13 Table
13*a* Plate portion
13*b* Plate portion
13*c* Through hole
14 Posture maintenance device
15 Sewing machine
15*a* Sewing machine foot
15*a*1 One side portion
15*a*2 Other side portion
15*b* Cutter
16 Conveying device (multi joint robot)
16*a* Fixed portion
16*b* First link portion
16*c* Second link portion
16*d* Rod
20 Clamping device
21 Holder
22 Tape pressing unit
23 Stopper pressing unit
23*a* Upper pressing unit
23*a*1 Front surface
23*b* Side pressing unit
23*b*1 Fixing piece
23*b*2 Hanging piece
23*c* Front surface
23*d* Rear surface
23*e* Left side surface
23*f* Right side surface
23*h* Inclined surface
24 Holder plate
24*a* Left side surface
24*b* Rear surface
24*c* Front surface
24*d* Inclined surface
24*p* Fixing plate portion
25 Connecting unit
25*a* First connecting unit
25*b* Second connecting unit
25*c* Joining unit
25*d* Through hole
25*e* Through hole
25*f* Bolt
30, 30A, 30B Tape separating device
31 Insertion piece
31*a* Fixed portion
31*b* Insertion portion
31*b*1 Upper surface
31*b*2 Rear surface
32 Insertion piece driving unit
32*a* Cylinder case
32*b* Piston rod
33 Guide
33*a* Guide rail
33*b* Movable element
33*b*1 Through hole
34 Block
35 Pipe
36 Claw portion
37 Support portion
G Gap

The invention claimed is:

1. An edge stitching device for a fly, wherein the fly, which is an object to be stitched, includes a lower fly body having an edge where a horizontal side and a vertical side extending straight in intersecting directions are joined by a curved side, in which a slide fastener on an upper side is superimposed on the fly body, an extending direction of the vertical side is aligned with a longitudinal direction of the slide fastener, two end portions of the fly body in an extending direction of the horizontal side are protruded from the slide fastener to two width direction sides of the slide fastener, the edge stitching device comprises:

a table on which the fly is placed;

a clamping device which sandwiches the fly in cooperation with the table;

a sewing machine which edge-stitches an edge of the fly body and is provided on the table;

a cutter provided in the sewing machine and configured to cut the fly body to form the curved side in the edge of the fly body; and a clamping device conveying device which conveys the clamping device in a state where the fly is sandwiched by the clamping device in the cooperation with the table, the clamping device conveying device continuously performs: pre-edge-stitching conveyance, in which the clamping device is linearly conveyed toward the sewing machine in a state where the fly is sandwiched before edge stitching; and edge stitching conveyance, in which the clamping device is conveyed in a state where the fly is sandwiched during the edge stitching, and in the edge stitching conveyance, the clamping device is conveyed in accordance with a shape of the curved side formed by the cutter.

2. The edge stitching device for the fly according to claim 1, wherein in the edge stitching conveyance, the clamping device is continuously conveyed in accordance with the shape of the curved side and a shape of the vertical side.

3. The edge stitching device for the fly according to claim 2, wherein the sewing machine includes a dedicated conveying unit which conveys the fly, and after the clamping device conveying device conveys the clamping device in accordance with the shape of the curved side, the dedicated conveying unit conveys the fly in accordance with the shape of the vertical side.

4. The edge stitching device for the fly according to claim 1, wherein the clamping device includes a holder which presses the fly, and a holder driving unit which moves the holder toward and away from an upper surface of the table, and the holder includes a tape pressing unit which presses a tape of the slide fastener.

5. The edge stitching device for the fly according to claim 4, wherein the holder includes a stopper pressing unit which presses a stopper of the slide fastener.

6. The edge stitching device for the fly according to claim 5, wherein the stopper pressing unit includes an upper pressing unit which presses from above so as to sandwich the stopper in cooperation with the table, and a side pressing unit which presses the stopper from the width direction side.

7. An edge stitching device for a fly, wherein the fly, which is an object to be stitched, includes a lower fly body having an edge where a horizontal side and a vertical side extending straight in intersecting directions are joined by a curved side, in which a slide fastener on an upper side is superimposed on the fly body, an extending direction of the vertical side is aligned with a longitudinal direction of the slide fastener, two end portions of the fly body in an extending direction of the horizontal side are protruded with respect to the slide fastener to two width direction sides of the slide fastener, the edge stitching device comprises:

a table on which the fly is placed;

a sewing machine, which is provided on the table and edge-stitches the fly, the sewing machine including a sewing machine foot which sandwiches the fly in cooperation with the table;

a pre-edge-stitching conveying device, which linearly conveys the fly on the table toward the sewing machine before edge stitching;

an edge stitching conveying device, which conveys the fly in accordance with a shape of an edge of the fly body during the edge stitching; and a tape separating device, which moves one edge stitching side end portion of a tape of the slide fastener which is an end portion in a longitudinal direction of the tape, above the sewing machine foot and away from the fly body on the table before the edge stitching.

8. The edge stitching device for the fly according to claim 7, wherein the tape separating device includes an insertion piece configured to be inserted between the fly body and the tape, and an insertion piece driving unit, which moves the insertion piece to a first position between the fly body and the tape and a second position away from a position between the fly body and the tape.

9. The edge stitching device for the fly according to claim 7, wherein the tape separating device is a suction device which suctions the tape.

10. The edge stitching device for the fly according to claim 7, wherein the tape separating device is a chuck device which grasps the tape from above.

* * * * *